US008627602B2

(12) United States Patent
Yates

(10) Patent No.: US 8,627,602 B2
(45) Date of Patent: Jan. 14, 2014

(54) GATE ASSEMBLY

(75) Inventor: Adam Yates, Harrogate (GB)

(73) Assignee: Lindham Limited, Harrogate (GB)

( * ) Notice: Subject to any disclaimer, the term of this patent is extended or adjusted under 35 U.S.C. 154(b) by 301 days.

(21) Appl. No.: 12/170,701

(22) Filed: Jul. 10, 2008

(65) Prior Publication Data

US 2009/0071074 A1 Mar. 19, 2009

(30) Foreign Application Priority Data

Jul. 12, 2007 (GB) ..... 0713567.6

(51) Int. Cl.
*E06B 7/00* (2006.01)

(52) U.S. Cl.
USPC ..... 49/55; 49/57

(58) Field of Classification Search
USPC ..... 49/55, 57, 463, 465; 160/211, 227, 228
See application file for complete search history.

(56) References Cited

U.S. PATENT DOCUMENTS 4,607,455 A * 8/1986 Bluem et al. ..... 49/55
4,846,246 A * 7/1989 Stern ..... 160/224
4,944,117 A * 7/1990 Gebhard et al. ..... 49/55
4,968,071 A * 11/1990 Stern ..... 292/150
5,052,461 A * 10/1991 Stern ..... 160/224
5,272,840 A * 12/1993 Knoedler et al. ..... 49/463
5,367,829 A * 11/1994 Crossley et al. ..... 49/465
5,528,859 A * 6/1996 Taylor et al. ..... 49/55
5,535,552 A * 7/1996 Stern ..... 49/465
5,570,543 A * 11/1996 Bishop ..... 49/465
5,782,039 A * 7/1998 Scherer et al. ..... 49/465
5,829,505 A * 11/1998 Brescia ..... 160/225
5,906,068 A * 5/1999 Bode ..... 49/55
5,924,242 A * 7/1999 Macari et al. ..... 49/55
6,161,334 A * 12/2000 Goodin ..... 49/125
6,449,901 B1 * 9/2002 Gibree et al. ..... 49/57
6,681,523 B1 * 1/2004 Stener ..... 49/55
7,716,874 B2 * 5/2010 Ventrola ..... 49/55
2006/0059779 A1 * 3/2006 Ventrola ..... 49/55

FOREIGN PATENT DOCUMENTS

EP 1788186 5/2007
EP 2014863 7/2008
EP 2014863 6/2011

* cited by examiner

*Primary Examiner* — Jerry Redman
(74) *Attorney, Agent, or Firm* — Robert Z. Evora, Esq.

(57) ABSTRACT

A gate assembly is provided for positioning in an opening through which selective access is required in use. The gate assembly includes two or more gate panels movably mounted to each other via movement means to allow adjustment of the overall width of the gate assembly to allow fitting of said gate assembly in the opening in use. The movement means including protruding means provided on at least one of said gate panels which are slidably mounted in a slot or channel provided on the other of said gate panels. At least two spaced apart location means are associated with the slot or channel for receiving the protruding means, thereby providing at least two pre-defined width positions for said gate panels.

16 Claims, 17 Drawing Sheets

102
102
10
12
12
30'
30
30'
8
12'
12'
108
110
14
10
16'
16'
8
14'

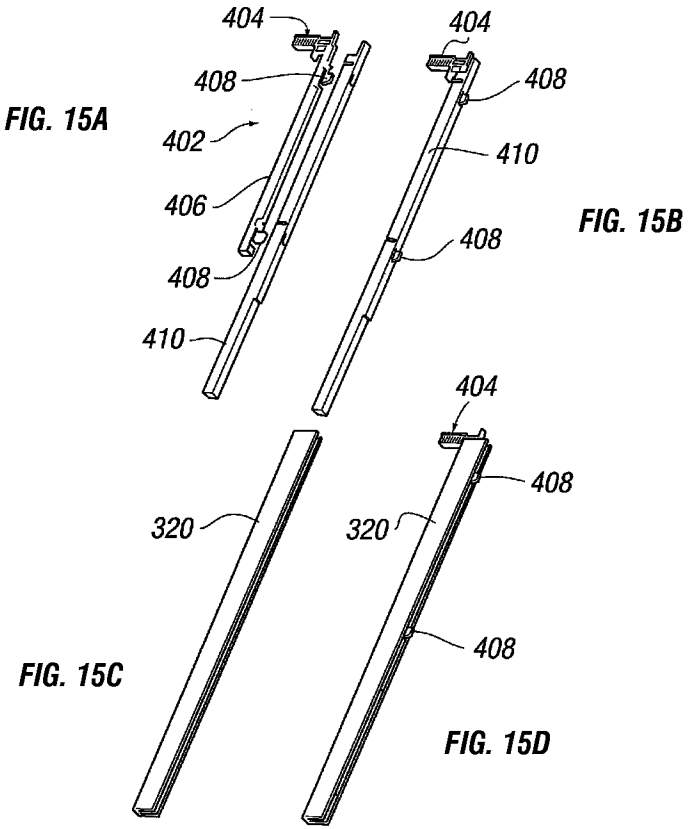
404
408
402
406
408
410
FIG. 15A
404
408
410
408
FIG. 15B
320
FIG. 15C
404
408
320
408
FIG. 15D
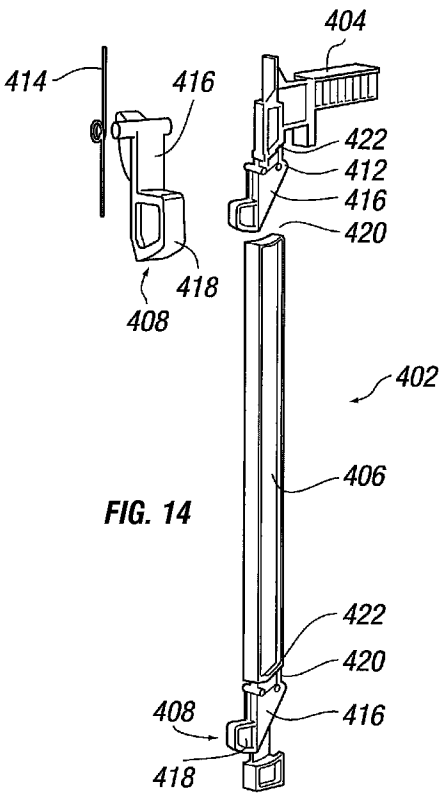
404
422
412
416
420
402
406
422
420
416
416
418
408
414
408
418
FIG. 14

GATE ASSEMBLY

This invention relates to a gate assembly, and particularly but not necessarily exclusively to a gate assembly in the form of a child safety barrier.

It is an aim of the present invention to provide an improved gate assembly.

It is a further aim of the present invention to provide a method of using a gate assembly.

It is a yet further aim of the present invention to provide a method of assembling a gate assembly.

According to a first aspect of the present invention there is provided a gate assembly for positioning in an opening through which selective access is required in use, said gate assembly including two or more gate panels movably mounted to each other via movement means to allow adjustment of the overall width of the gate assembly to allow fitting of said gate assembly in said opening in use, the movement means including protruding means provided on at least one of said gate panels which are slidably mounted in a slot or channel provided on the other of said gate panels, characterised in that at least two spaced apart location means are associated with said slot or channel for receiving said protruding means, thereby providing at least two pre-defined width positions for said gate panels.

Preferably locking means are associated with the protruding means and are movable relative to the protruding means between a locked positioned, wherein the protruding means are locked in a required position in said slot or channel to maintain the gate panels at a required width, and an unlocked position, wherein the protruding means are movable in said slot or channel and the position of the gate panels relative to each other can be adjusted.

Preferably the locking means is capable of locking the protruding means in any of the at least two spaced apart location means. The user can select which location means is chosen according to the width of the overall gate assembly required to fit in the opening. Thus, the protruding means can slide between the at least two location means via the channel or slot in the unlocked position and can be locked in place in a location means in the locked position.

Preferably resilient biasing means are provided with or associated with the protruding means to bias said protruding means into engagement with one of the location means. The resilient biasing means allows the protruding means to be movable out of the location means when the locking means is in an unlocked position and at least one of the gate panels is moved relative to the other of said gate panels.

The resilient biasing means is preferably in the form of a spring, sprung material and/or the like.

Preferably the protruding means is capable of moving in a reciprocal manner substantially perpendicularly with respect to the location means, the direction of sliding movement of the gate panels and/or longitudinal axis of said slot or channel when moving between engaged and disengaged positions with the location means.

The locking means are movably mounted with respect to the protruding means to provide the locked and unlocked positions.

Preferably the locking means are slidably mounted relative to said protruding means. Further preferably the locking means includes a locking arm which is slidably mounted in a housing on a gate panel and preferably said locking arm or locking means is moved substantially perpendicular to the direction of movement of said protruding means. The locking means or housing is typically provided on at least one of the gate panels and preferably the housing is provided on an end wall of at least one of the gate panels. The housing can be attached to the gate panel or can be integrally formed therewith.

In the unlocked position, at least part of the locking means (and preferably an end of the locking arm) protrudes outwardly from an opening defined in the housing at the end of the gate panel. The locking means or locking arm is moved inwardly of the housing and/or gate panel to move the locking means to the locked position. The locking means are moved in the reverse direction to move the same from a locked position to an unlocked position. User actuation means can be associated with the locking means, and preferably with an end of the locking arm, to allow a user to easily move said locking means between the locked and unlocked positions.

The two or more location means are preferably spaced apart along the longitudinal axis of the channel or slot.

Preferably the location means are provided with one or more ramps or angled side walls to aid movement of the protruding means into and out of the location means when the gate panels are moved relative to each other in the unlocked position.

Preferably the free end of the protruding means has one or more curved or angled side walls to aid movement of the protruding means out of the location means when the gate panels are moved relative to each other in the unlocked position.

In one embodiment the location means are in the form of spaced apart recesses or further slots defined in a surface of a wall forming the slot or channel in which the protruding means is slidably mounted. The surface in which the location means are defined is typically substantially opposite to the adjoining gate panel and/or opening of said channel or slot.

Thus in one embodiment the recess forming the location means has a rear wall and one or more ramps of angled side walls joined thereto. The opening to the recess is provided substantially opposite the rear wall and opens into the channel or slot. The angled side wall or walls diverge outwardly from the rear wall so the opening is wider in dimension than the width of the rear wall. The outermost edges of the ramp or angled side wall typically define the opening of the recess.

In a preferred embodiment each gate panel is provided with protruding means and a slot or channel, the protruding means on one gate panel being movably mounted in the slot or channel on the other gate panel and vice versa. Thus, at least an end part of each gate panel is provided in overlapping engagement with the other gate panel.

Preferably each gate panel is provided with locking means for movement of the protruding means on said gate panel between said locked and unlocked positions. Preferably both gate panels have to be in an unlocked position to allow movement of the gate panels relative to each other.

According to an aspect of the present invention there is provided a method of using a gate assembly for positioning in an opening through which selective access is required in use, said gate assembly including two or more gate panels movably mounted to each other via movement means to allow adjustment of the overall width of the gate assembly to allow fitting of said gate assembly in said opening in use, the movement means including protruding means provided on at least one of said gate panels, and wherein said method includes the steps of sliding the protruding means in a slot or channel provided on the other of said gate panels, and locating the protruding means in one of at least two spaced apart location means associated with said slot or channel at a pre-defined width position suitable for securing the gate assembly in the opening.

According to a further aspect of the present invention there is provided movement means for use on a gate assembly.

According to a second aspect of the present invention there is provided a gate assembly, said gate assembly postionable in an opening through which selective access is required and including at least one gate panel movably mounted, directly or indirectly, to a surface at least partially defining said opening via hinge means, thereby allowing said gate panel to be moved between open and closed positions with respect to said opening, characterised in that said hinge means includes at least two hinge parts, each hinge part having a plurality of spaced apart protruding portions arranged longitudinally thereof with recesses defined between said protruding portions, the protruding portions on one of the hinge parts being movably located in the recesses of the other hinge part.

Thus, the hinge means is formed from a plurality of inter-engaging protruding portions or arm portions.

Preferably the hinge parts are pivotably movable relative to each other between said open and closed positions.

In one embodiment the hinge means are attached directly to a wall surface defining the opening.

In one embodiment the hinge means are attached indirectly a wall surface defining the opening via frame means, spacer means, extrusion means and/or the like.

The hinge means are arranged on one side of the gate assembly. This side is preferably opposite to the side on which a latching mechanism is provided. The hinge means can be provided along substantially the entire side of the gate assembly or partially thereof.

Preferably engagement means are associated with the protruding portions. The engagement means can include a pivot pin, screw, bolt and/or the like. The engagement means are preferably substantially elongate in form and are arranged substantially parallel to the side of the gate panel with the hinge means. The engagement means engages at least one protruding portion on one hinge part with at least one protruding portion on the other hinge part. Preferably the engagement means passes through a plurality of protruding portions on the first and second hinge parts.

Preferably the inter-engaging ends of the protruding portions have substantially curved side walls. As the protruding portions pivot relative to each other on opening and closing of the gate panel, the curved side walls will force any object out of the hinge, such as a user's fingers, which has accidentally been located or caught in the recess of the hinge means. This prevents a user, such as a small child, from trapping a finger or limb in the hinge means in use.

According to a third aspect of the present invention there is provided a gate assembly, said gate assembly postionable in an opening through which selective access is required and including at least one gate panel movably mounted, directly or indirectly, to a surface at least partially defining said opening via hinge means, thereby allowing said gate panel to be moved between open and closed positions with respect to said opening, characterised in that at least part of said hinge means includes resilient flexible means which flexes to allow the gate panel to move between said open and closed positions.

Preferably the flexible means is substantially elongate in form and the longitudinal axis of said flexible means is provided substantially parallel to the side of the gate panel.

Preferably at least a central part of said hinge means is formed from resilient flexible material. The ends of said hinge means can be formed from a stiffer, more rigid material to allow the ends of said hinge means to be engaged with suitable surfaces in use.

In one embodiment the hinge means are attached directly to a wall surface defining the opening.

In one embodiment the hinge means are attached indirectly a wall surface defining the opening via frame means, a wall extrusion, spacing means and/or the like.

The hinge means are arranged on one side of the gate assembly. The hinge means can be provided along substantially the entire side of the gate assembly or partially thereof.

The resilient flexible means can be formed of rubber and/or similar material.

According to a further aspect of the present invention there is provided hinge means for use on a gate assembly.

According to a fourth aspect of the present invention there is provided a gate assembly, said gate assembly postionable in an opening through which selective access is required and including at least one gate panel, engagement means provided for providing engagement between a surface defining said opening and said gate assembly, adjustment means associated with said engagement means for adjusting the width of the gate assembly to allow secure engagement of the gate assembly against said surface, and wherein indicator means are associated with said adjustment means and/or said engagement means to indicate to a user when said gate assembly is securely fitted.

Preferably the engagement means includes one or more friction pads.

Preferably the adjustment means includes a rotatably mounted screw, bolt or similar device. The engagement means are typically located at an end of said adjustment means and said adjustment means is rotated to move the same between extended and retracted positions, thereby increasing or decreasing the width of the gate assembly accordingly.

The adjustment means associated with the engagement means typically provides a fine level of width adjustment for the gate assembly, whereas extendible gate panels provide a broader level of width adjustment.

A tool may need to be used with said adjustment means to allow the adjustment means to be moved between extended and retracted positions. The adjustment means can include an Allen Key, screwdriver and/or the like.

The indication means can be visual, audible and/or kinaesthetic indication means. In a preferred embodiment the indication means are visual indication means and include markings or rulings provided on the adjustment means which are visible to a user.

In one embodiment the audible indicator means are in the form of an alarm. The alarm can be sounded if the gate assembly is not fitted correctly and/or if the gate is left in an open position.

Preferably the indicator means are associated with a latching mechanism of the gate assembly, engagement means, adjustment means, latching mechanism, hinge means and/or the like.

The indicator and/or adjustment means allows the required safety standard spacing provided that a gate must be positioned relative to a wall surface adjacent which the gate is fitted in use (currently 60 mm). In addition, it allows a user to determine whether a substantially even pressure is applied by the gate against a wall surface to ensure the gate is stably fitted.

According to a yet further aspect of the present invention there is provided a method of assembling a gate assembly.

Preferably the gate assembly is a modular construction and can be assembled by the user prior to use or can be assembled at the point of manufacture. Preferably each gate panel includes a plurality of strut members which are detachably attached in bottom and/or top frame members. For example, a protrusion in one of said strut members or frame members is located in a complementary shaped aperture or slot in the other of said strut members or frame members. Engagement means can be provided to ensure secure engagement of the strut members with the bottom and/or top frame members and said engagement means can include friction fit, welding, adhesive one or more screws, bolts, clips and/or the like.

Preferably the gate assembly includes a frame and the frame is joined directly or indirectly to a wall surface defining the opening. The gate panel is typically mounted to the frame and moves between the open and closed positions with respect to the frame.

In one embodiment the frame is mounted to a wall extrusion or spacing element and the wall extrusion and/or spacing element is joined to the wall defining the opening.

Preferably one or more cover panels are provided on the gate assembly to allow connection points, attachment means and/or the like to be covered in use.

According to a yet further aspect of the present invention there is provided a latching mechanism for a gate assembly, said latching mechanism including at least one latching portion which is movable between a latched and unlatched position on actuation of user actuation means, and wherein said latching portion is pivotably movable between said latched and unlatched positions.

Preferably the latching portion is resiliently biased to the latched position via biasing means. The biasing means can include a spring, sprung material and/or the like.

Preferably the user actuation means includes a handle and further preferably the handle is actuated by moving the same in an upwardly direction with respect to the gate assembly.

Preferably a button or other user selection means needs to be actuated prior to or substantially simultaneously to lifting the handle. In one example, a button needs to be depressed on the handle so that the handle can be lifted in an upwardly direction.

On movement of the handle in an upwardly direction towards a top part of the gate assembly, at least part of the latching portions are moved in a corresponding upwardly direction. During this movement, the latching portions engage with an angled surface, thereby causing the latching portions to pivot from the latched to the unlatched position. The provision of upwardly movable latched and/or handles removes the requirement for a user to have to lift the gate assembly in use to open the gate.

Preferably the handle and latching portions are movably mounted in a housing. The housing is typically in the form of an elongate arm with spaced apart apertures, slots or channel (s) defined therein for movement of the latching portions between extended and recesses positions relative to said apertures, slots or channel.

In one embodiment an auto-close mechanism could be provided on the gate assembly to allow automatic closing of the gate when left in an open position.

According to an aspect of the present invention there is provided a method of using a gate assembly having any or any combination of the abovementioned features.

It will be appreciated that the present invention can include any or any combination of the abovementioned features.

Embodiments of the present invention will now be described with reference to the accompanying figures, wherein:

FIG. 14 illustrates an exploded view of a latching mechanism for use on the gate assembly of the present invention;

FIGS. 15A-15D illustrate an exploded view, two partially exploded views and assembled view of the components of the latching mechanism respectively;

Figure 1:
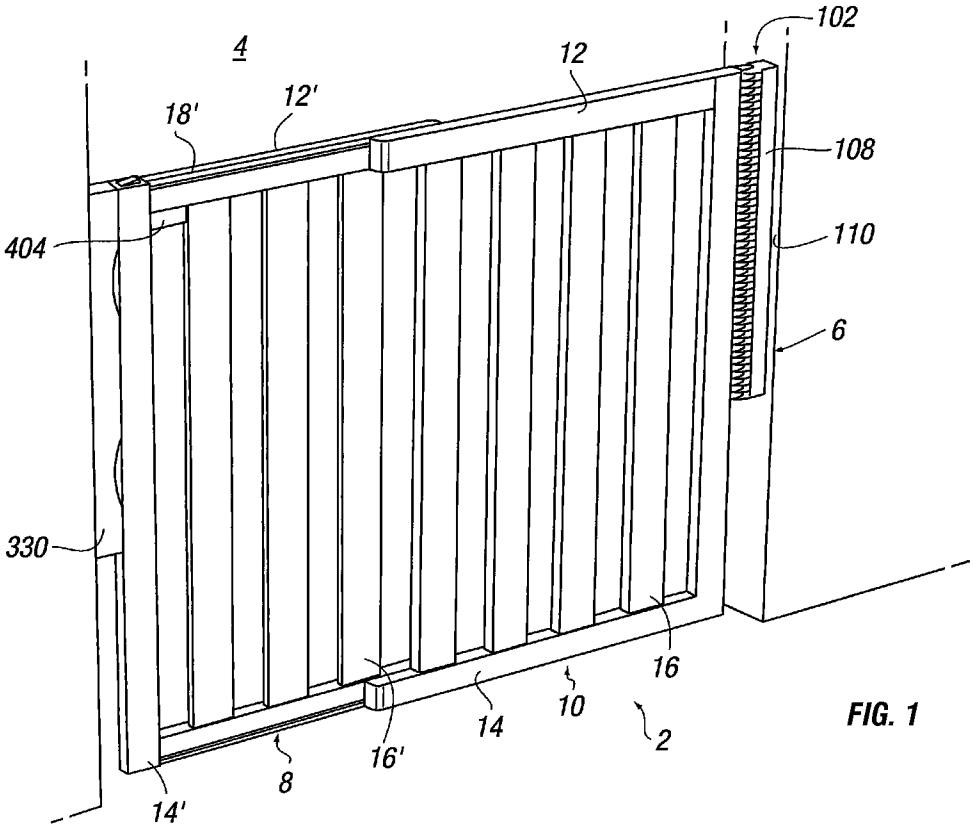
FIG. 1 is a perspective view of a gate assembly according to an embodiment of the present invention fitted in an opening in use.
Figures 2A, 2B:
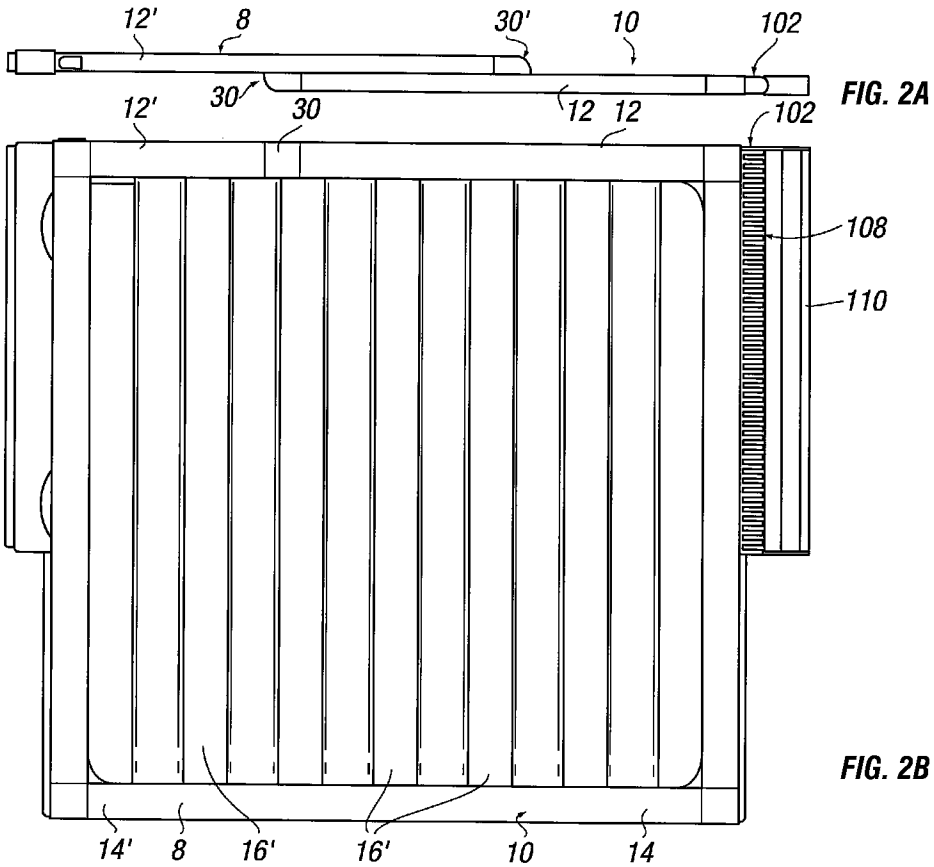
FIGS. 2A and 2B show a front view and top plan view of the gate assembly in FIG. 1 respectively.
Figure 3:
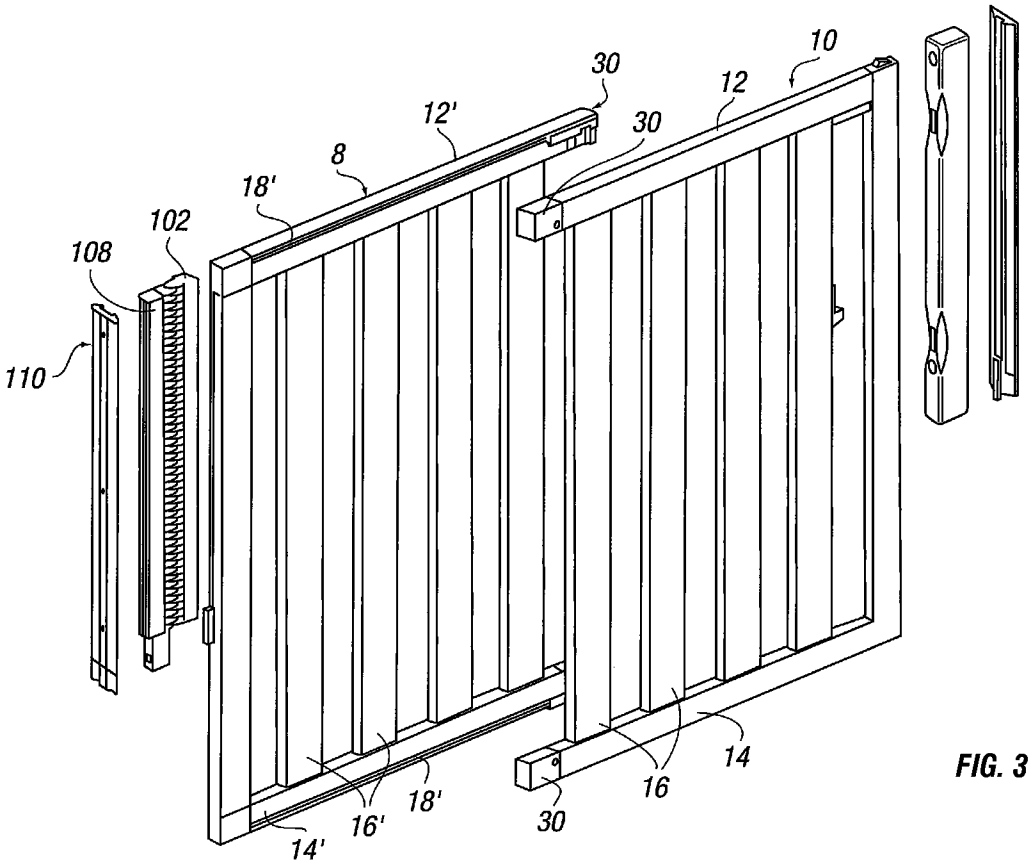
FIG. 3 is an exploded view of the gate assembly in FIG. 1.
Figure 4:
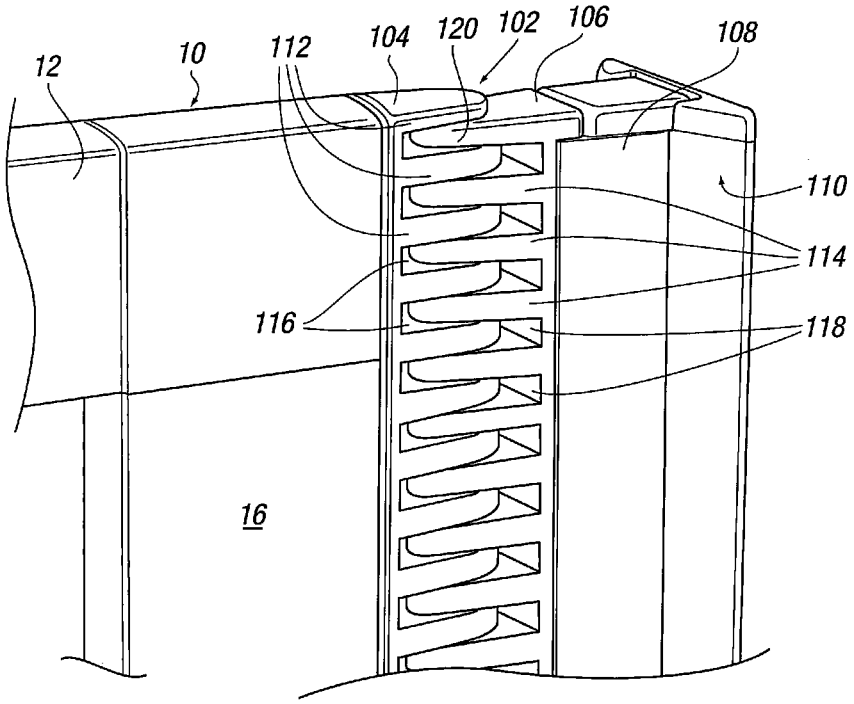
FIG. 4 is an enlarged detailed view of a hinge mechanism in one embodiment of the gate assembly.

Referring to the figures, there is illustrated a gate assembly 2 in the form of a child safety barrier for location in the opening 4 of a doorway 6 through which selective access is required. The gate assembly is movable between open and closed positions with respect to the doorway. It will be appreciated the opening could be any suitable doorway, opening, stairway and/or the like. Different features of the gate assembly will now be described below. It will be appreciated by persons skilled in the art that any or any combination of features can be provided on the gate assembly of the present invention.

Extendible Gate Assembly

In accordance with a first aspect of the present invention, gate assembly 2 is extendible to allow the width of the gate to be adjusted for fitting the same into different sized openings, as shown in FIGS. 1-3, 9A-10C.

The extendible gate includes two gate panels 8, 10, end parts of which are provided in overlapping engagement with each other in use. The gate panels 8, 10 have movement means to allow the gate panels to be slidably moved relative to each other for adjusting the overall width of the gate panels. Thus, the gate panels can be moved between retracted and extended positions with respect to an opening.

Each gate panel 8, 10 includes a top panel member 12, 12', a bottom panel member 14, 14' and a plurality of upright struts 16, 16' provided at spaced distances apart between the top and bottom panel members.

An inner surface of each of top panel members 12, 12' and bottom panel members 14, 14' is provided with an elongated channel 18, 18' substantially parallel with the longitudinal axis of said top member. Location means in the form of a plurality of shaped recesses 20' are provided at spaced distances apart on the opposite surface 22' from the opening 24' of the channel. These shaped recesses 20' act as pre-determined width positions for the two gate panels relative to each other. More particularly, each recess 20' includes a rear wall 26 and side walls 28 provided at an acute angle relative to said rear wall, thereby providing each recess with front and rear ramps.

The overlapping ends 30', 30 of each gate panel 8, 10 respectively has an engaging arm 32 which protrudes through opening 24' of channel 18' of the opposite gate panel and is slidably mounted therein. Thus, engaging arm 32 is movable relative to the longitudinal axis of top panel member 12'. Engagement of arm 32 in channel 18' is such that the gate panels cannot be easily separated once assembled.

Figure 10A:
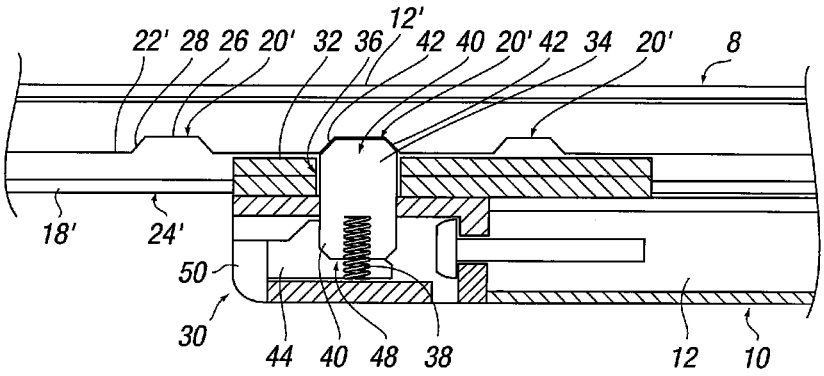
FIGS. 10A-10C illustrate cross sectional views of the movement means in FIGS. 9A-9C in a locked position, unlocked position and intermediate position respectively.
Figure 10B:
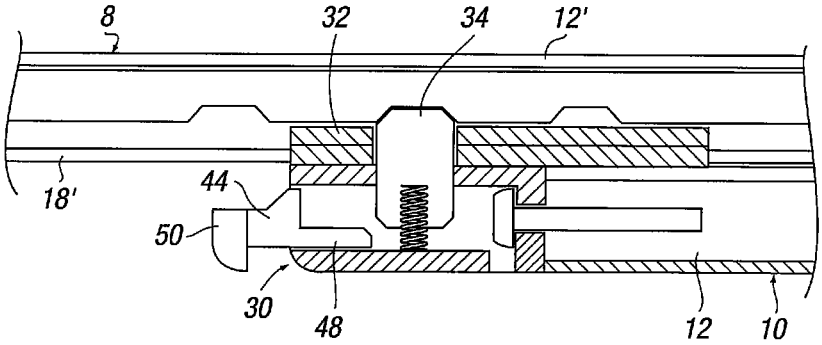
Figure 10C:
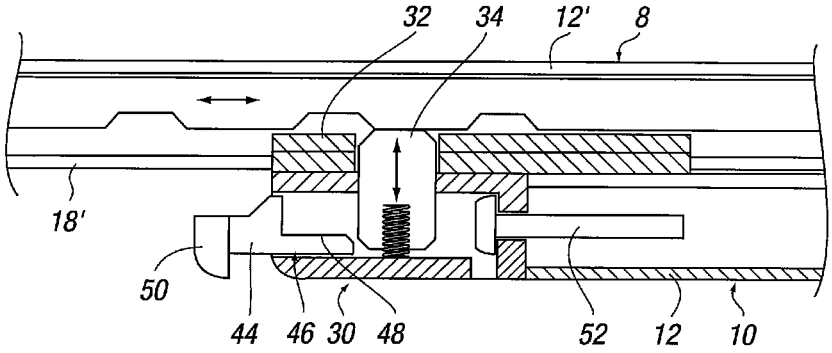

A protruding member in the form of a bolt 34 is movable relative to an aperture 36 defined in arm 32 between a protruding position, as shown in figures 10A and 10B, and a recessed position, as shown in figure 10C. A spring 38 is joined to the rear 40 of bolt 34 to resiliently bias bolt 34 to the protruding position. Thus, bolt 34 is movable substantially perpendicularly to the longitudinal axis of channel 18' and engaging arm 32.

The free end 40 of bolt 34 is provided with angled side edges 42 which are substantially complementary to side walls 28 of the recesses 20', thereby allowing the bolt to be slid into and out of the recesses 20' on relative sliding movement of the gate panels as will be described in more detail below.

Locking means in the form of a movable locking arm 44 is slidably mounted relative to an opening 46 defined in end 30 of the gate panel 10 between a locked position, wherein a recess 48 defined at an inner end of arm 44 engages with rear 40 of bolt 34, as shown in FIGS. 10A, and an unlocked position, wherein recess 48 is moved a spaced distance apart from rear 40 of bolt 34, as shown in figures 10B and 10C. Thus, locking arm 44 is moved substantially parallel to the longitudinal axis of top panel member 10. A user actuation portion 50 is provided at free end of arm 44 and forms part of the shaped end of the gate panel when in the locked position. Portion 50 allows a user to move locking arm 44 between the locked and unlocked positions. Thus, in the locked position, portion 50 abuts against end 30 of gate panel 10 and locking arm 44 is recessed within end 30 of gate panel 10. In the unlocked position, portion 50 is a spaced distance apart from end 30 of gate panel and part of locking arm 44 protrudes from end 30 of gate panel 10.

The end of locking arm 44 engaging with the rear of bolt 34 is provided with a narrowing tapered or curved end which engages with a narrowing tapered or curved end of bolt 34 to provide relatively smooth reciprocal movement of the arm 44 relative to bolt 34.

In operation of the movement means, when a user wishes to adjust the width of the gate assembly, the user slides out user actuation portion 50 from end 30 to an unlocked position, thereby removing locking arm 44 from engagement with the rear 40 of bolt 34. The user then grips the top panel members 8, 10 and slides the engaging ends of the members away from each other, thereby reducing the width of the gate, or slides the engaging ends of the members towards each other, thereby increasing the width of the gate.

On relative movement of the gate panels 8, 10, bolt 34 is slidably moved out of a recess 20' (i.e. in a direction substantially parallel to the longitudinal axis of the top member), this movement aided by the angled ends 42 of bolt 34 sliding up a ramp in recess 20' defined by side walls 28. When bolt 34 contacts surface 22', the resilience of spring 38 causes bolt 34 to slidably move relative to aperture 36 to a recessed position, thereby allowing engaging arm 32 to freely slide in channel 18. When bolt 34 passes an adjacent recess 20', bolt 34 is resiliently biased into the recess and the user hears a clicking sound, thereby informing the user that one of the pre-determined width settings has been reached. The user can continue to slide the gate panels to find a further recess 20' or can lock the bolt 34 in the already reached recess 20'. In order to lock the gate panels in the required setting, the user pushes portion 50 into engagement with end 30 of gate panel 10, thereby bringing locking arm 44 into engagement with the rear 40 of bolt 34.

The housing assembly end 30 is typically engaged to top panel member 12 by a bolt 52.

Each gate panel typically has movement means of the type described above, so that an engaging arm 32, 32' on each gate panel 10, 8 is slidably mounted in the channel 18, 18' of the other gate panel 10, 8. The same reference numerals are used to designate the same components with a ' used to designate components on gate panel 8. Similar movement means can also be provided on both the top and bottom panel members 12, 12' and 14, 14' respectively.

Both the top and bottom panel members of each gate panel can have movement means of the type described above. Locking means are preferably provided on the top panel member only but could be provide on the bottom panel member if required.

Hinge Means

In accordance with a second aspect of the present invention there is provided hinge means 102 for a gate assembly, as shown in FIGS. 1-4. The hinge means can be used on any gate assembly and not just an extendible gate assembly as in the figures.

Hinge means 102 includes a first hinge part 104 joined to an end strut 16 of gate panel 10 and a second hinge part 106 joined to an upright spacing element 108. Upright spacing element 108 is joined to a wall extrusion member 110 for attachment to a wall surface 6 defining opening 4. Each hinge part 104, 106 is substantially elongate in form and the longitudinal axis of said hinge parts is substantially parallel to strut 16.

Each hinge part 104, 106 include a plurality of protruding fingers 112, 114 protruding substantially perpendicularly to the longitudinal axis of said hinge part. The protruding fingers 112, 114 are provided a spaced distance apart with recesses 116, 118 defined therebetween. When assembled, the protruding fingers on one of the hinge parts are located in the recesses of the other hinge part, thereby forming a plurality of inter-engaging or stacked fingers. Engagement means in the form of an elongate hinge pin (not shown) is provided through the ends 120 of the protruding fingers and substantially parallel to the longitudinal axis of the hinge parts to keep the hinge parts engaged together. The hinge pin allows pivotable movement of the fingers 112, 114 relative to each other to allow the gate panel 10 to be moved between open and closed positions with respect to the doorway opening 4. The ends 120 of the fingers 112, 114 are also curved in shape to allow anything that might be trapped in a recess 114, 116 to be forced out on movement of the hinge parts relative to each other.

Figure 5:
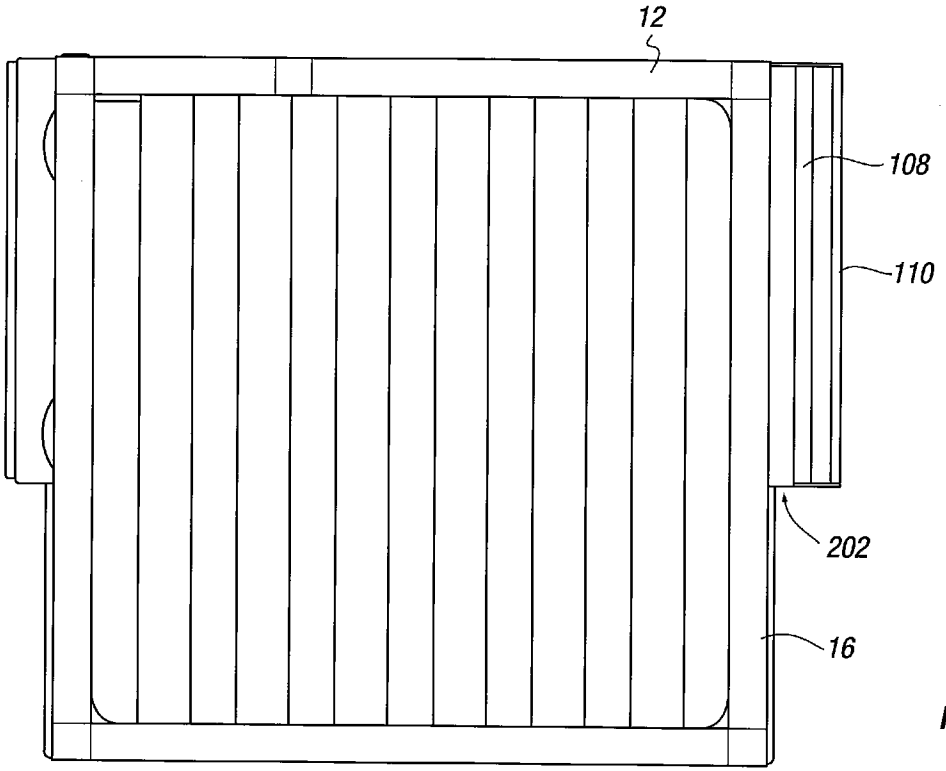
FIG. 5 is a front view of a gate assembly using a hinge mechanism according to a second embodiment of the present invention.
Figure 6A:
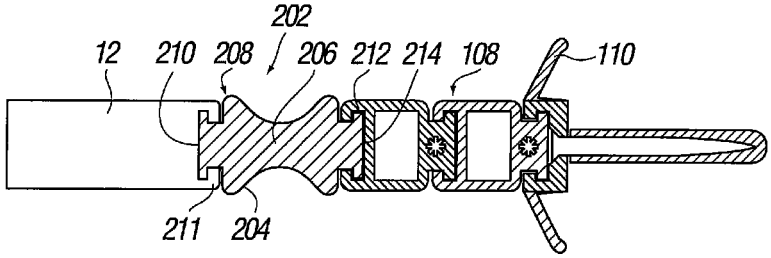
FIGS. 6A-6C illustrate detailed top plan views of the hinge mechanism in FIG. 5 in a first closed position; in a second closed position and in an open position respectively.
Figure 6B:
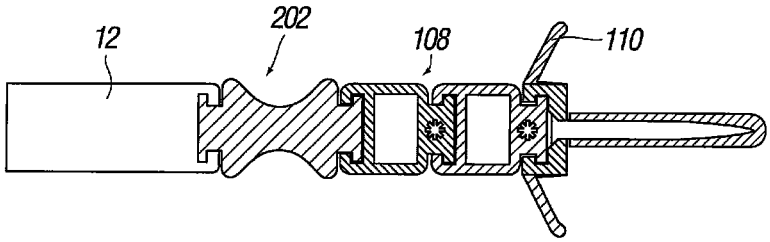
Figure 6C:
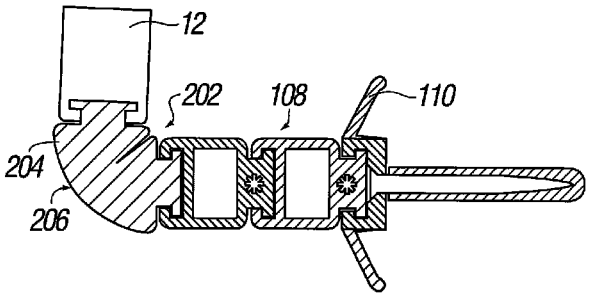

In accordance with a third aspect of the present invention and with reference to FIGS. 5-6C, there is illustrated alternative hinge means 202 for use on a gate assembly according to the present invention.

The hinge means 202 includes a resilient elongate rubber hinge member 204 which is substantially flexible, at least in a central portion 206 thereof. Hinge member 204 has a first end 208 which is of substantially complementary shape to a recess 210 defined along the end 211 of gate panel 10, and a second end 212 which is of substantially complementary shape to a recess 214 defined along an end of spacing element 108. The inherent flexibility and resilience of hinge member 204 allows gate panel 10 to be pivoted between open and closed positions about central portion 206.

Indicator Means

According to a fourth aspect of the present invention, there is provided indicator means for use on a gate assembly to allow a user to visually determine when the gate assembly is correctly fitted in an opening.

Figure 7:
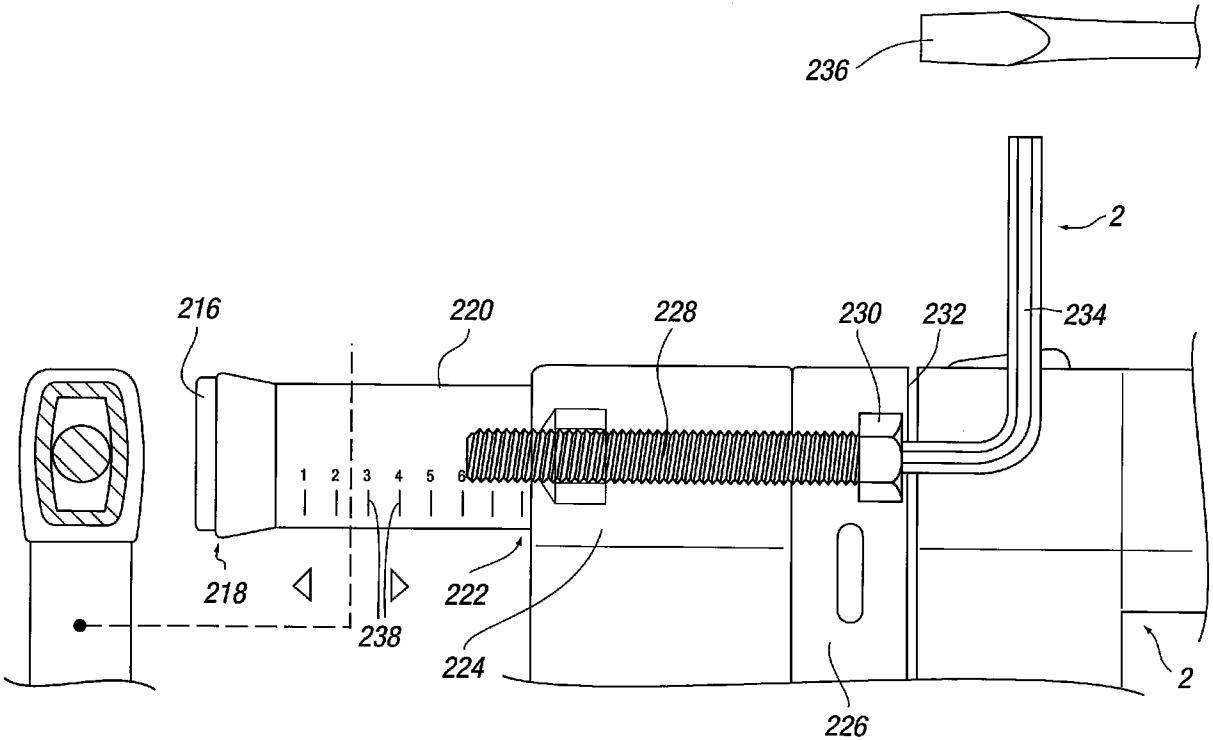
FIG. 7 illustrates indication means on an engagement arm of a gate assembly in one embodiment of the present invention.
Figure 8:
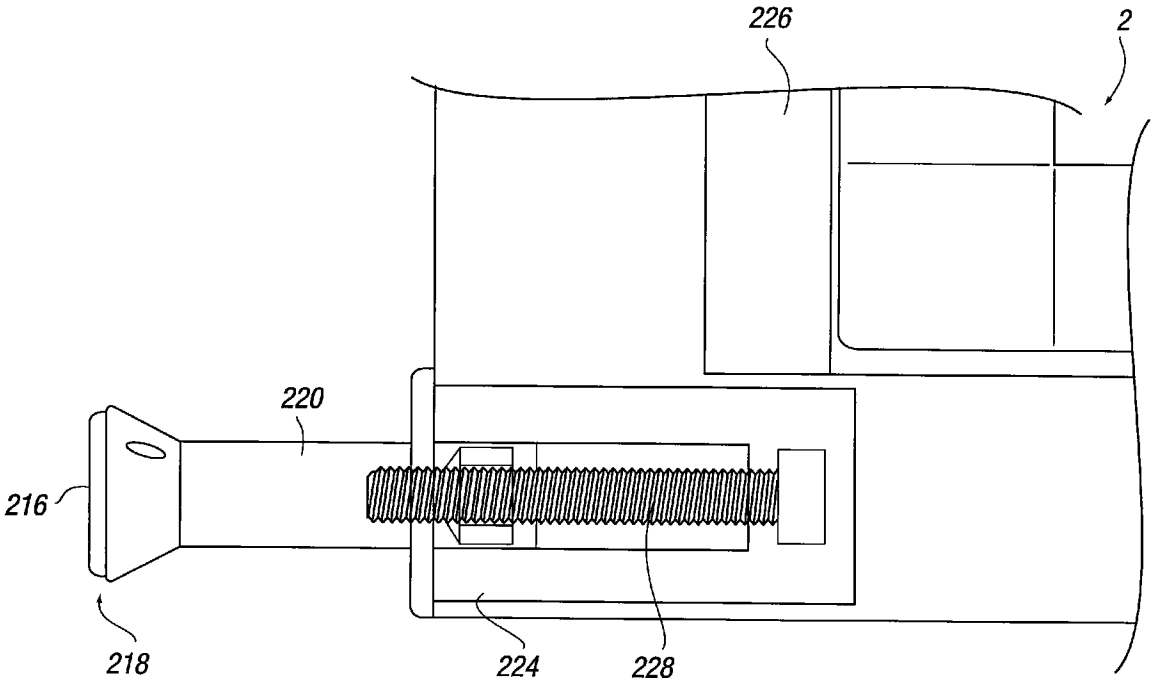
FIG. 8 illustrates adjustment means for a gate assembly in one embodiment of the present invention.
Figure 9A:
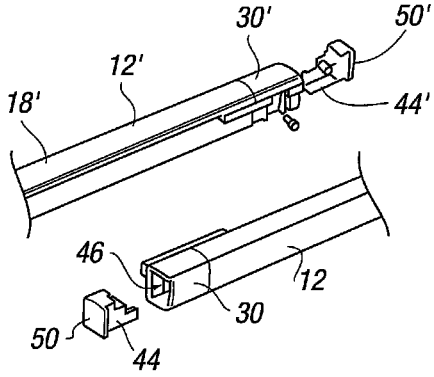
FIGS. 9A-9C illustrate exploded views of the movement means for adjusting the width of the gate panels.
Figure 9B:
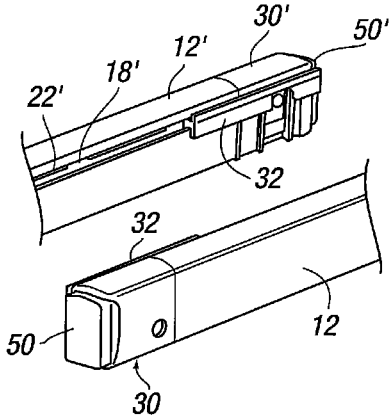
Figure 9C:
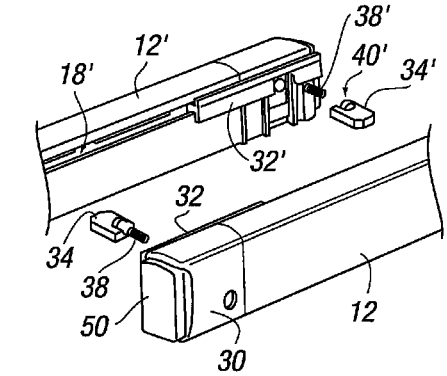

With reference to FIGS. 7 and 8, there is illustrated engagement means in the form of a friction pad 216 provided at an end 218 of an adjustment arm 220. An opposite end 222 of adjustment arm 220 is movably located in a channel defined in housing 224. The housing 224 is joined to a frame 226 to which a gate assembly 2 is movable relative thereto.

A threaded bolt 228 is joined to end 222 and passes through housing 224 and frame 226, the head 230 of bolt 228 being substantially flush or recessed with end 232 of frame 226. An Allen key 234 or screw driver head 236 can be located in a suitable shaped aperture in head 230 to allow rotation of bolt 228 when the gate is open. This rotation moves bolt 228 and thus arm 220 and friction pad 216 between extended and retracted positions to allow secure engagement of friction pad 216 with a wall surface defining an opening in which the gate assembly is located.

Ruler markings 238 are provided on adjustment arm 220 to allow a user to move the adjustment arm to a pre-determined setting and/or to compare the setting to other adjustment arms provided on the gate.

For example, adjustment arms can be provided adjacent each corner of the gate assembly to engage with a wall surface and the indicator means can allow a user to determine whether the engaging force at each corner of the gate is substantially the same. It is not essential for the visual indicator means to be provided and FIG. 8 illustrates a similar adjustment mechanism to the one shown in FIG. 7 on a lower part of the gate assembly but the indicator markings are not provided.

Modular Construction

According to a further aspect of the present invention, the gate assembly in one embodiment is provided in a modular construction. The components of the gate assembly can be detachably attached to allow erection and dismantling of the gate assembly by a user at the site of use or by a manufacturer.

Figure 16:
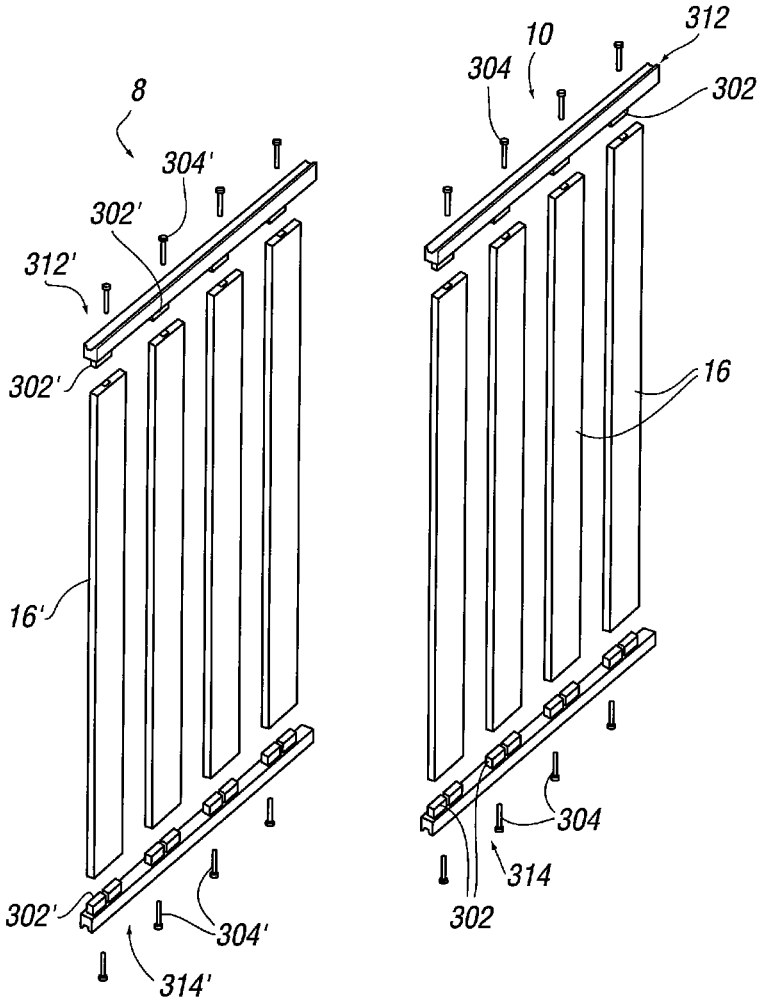
FIG. 16 illustrates an exploded view of the gate panels forming the gate assembly in one embodiment.

Referring to FIG. 16, the upright struts 16, 16' of each gate panel 8, 10 are detachably attached to protrusions 302, 302' defined at spaced intervals on the top and base surfaces of the bottom sub panel member 314, 314' and top sub panel member 312, 312' respectively. The protrusions are located in open ends of the struts 16, 16'. Screws 304, 304' can be located through the top and bottom sub panel members to securely engage the struts thereto.

Figure 17A:
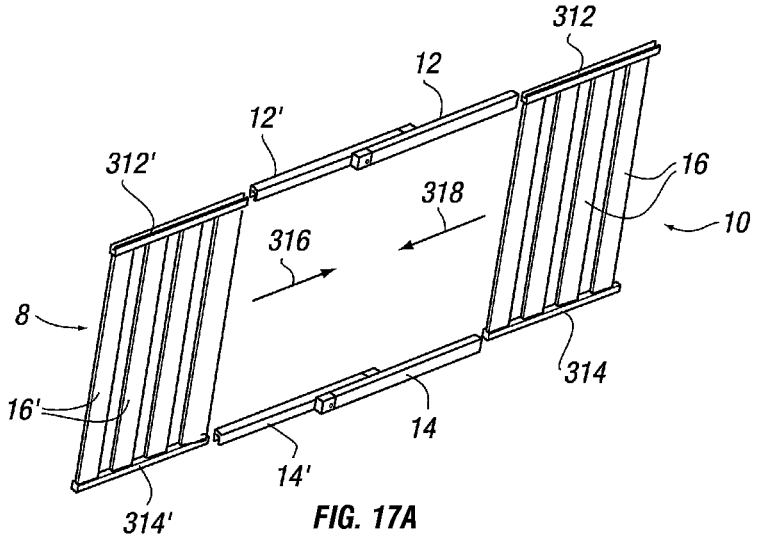
FIG. 17A-17B illustrate exploded views of the gate panels forming the gate assembly in one embodiment.
Figure 17B:
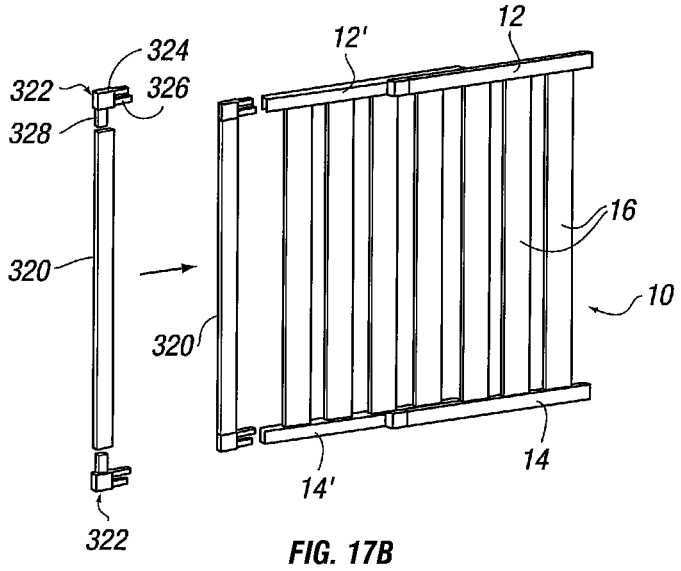

The bottom and top sub panel members 314, 314', 312, 312' are then slidably engaged with bottom and top panel members 14, 14', 12, 12' respectively, as shown in figure 17A. More particularly, bottom and top panel members 14, 14', 12, 12' are engaged together by the movement mechanism described above and bottom and top sub panel members of gate panels 8, 1.0 are slid inwardly towards each other, as shown by arrows 316, 318. The end struts 320 of each gate panel 8, 10 which are closest to the wall surface when fitted have corner components 322 detachably attached to the end of each panel member and to the opening of the strut 320. The corner components 322 are 'I,' shaped having a body part 324 and two protruding parts 326, 328 provided substantially perpendicular to each other on adjacent sides of said body part 324.

Figure 18:
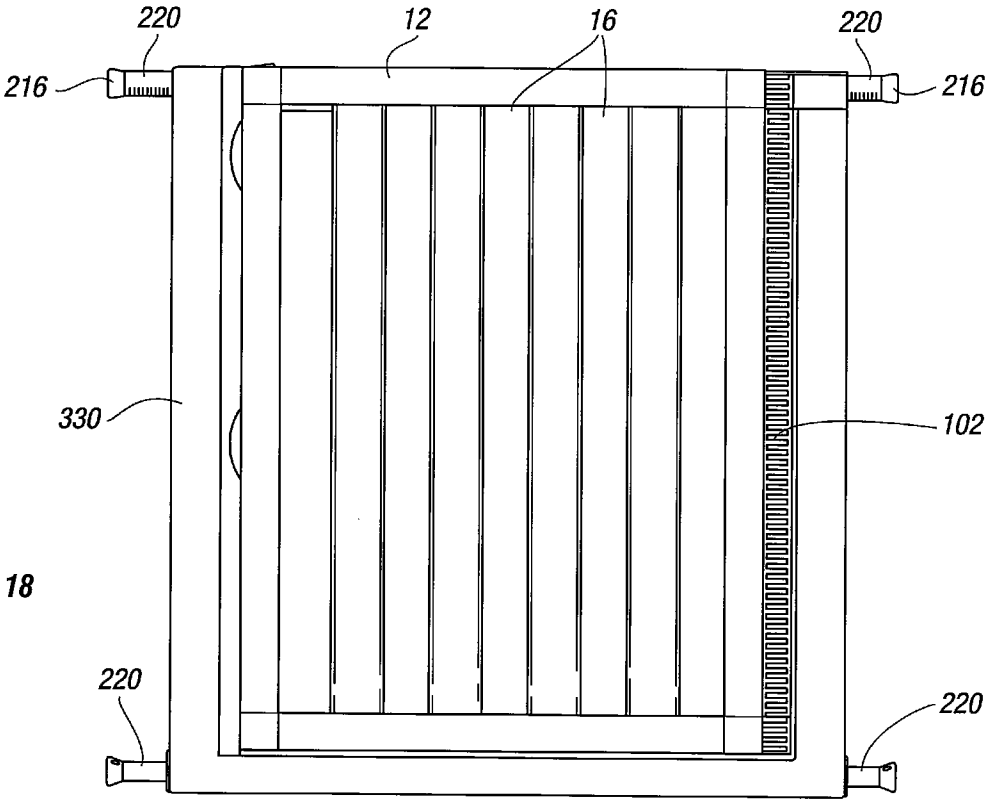
FIG. 18 illustrates a further example of a gate assembly according to an embodiment of the present invention.

A frame can be provided around the gate panels to which at least part of the gate panel can be mounted to in use. In FIG. 1, a frame 330 is defined on the left hand side of the gate assembly and houses a latching mechanism. The frame 330 is joined to wall surface 6 and is provided only partially down the side of the gate assembly. In FIG. 18, the frame 330 is provided around substantially the entire gate assembly (i.e. on the base and two sides).

Figure 11:
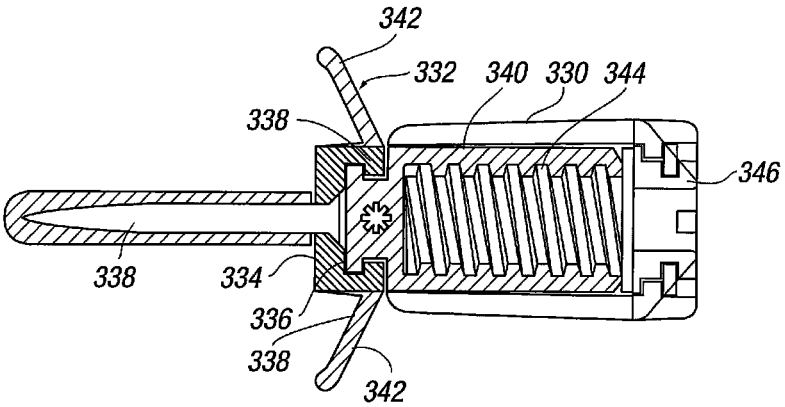
FIG. 11 illustrates a possible attachment mechanism for attaching a frame of the gate assembly to a wall surface defining the opening.
Figure 13:
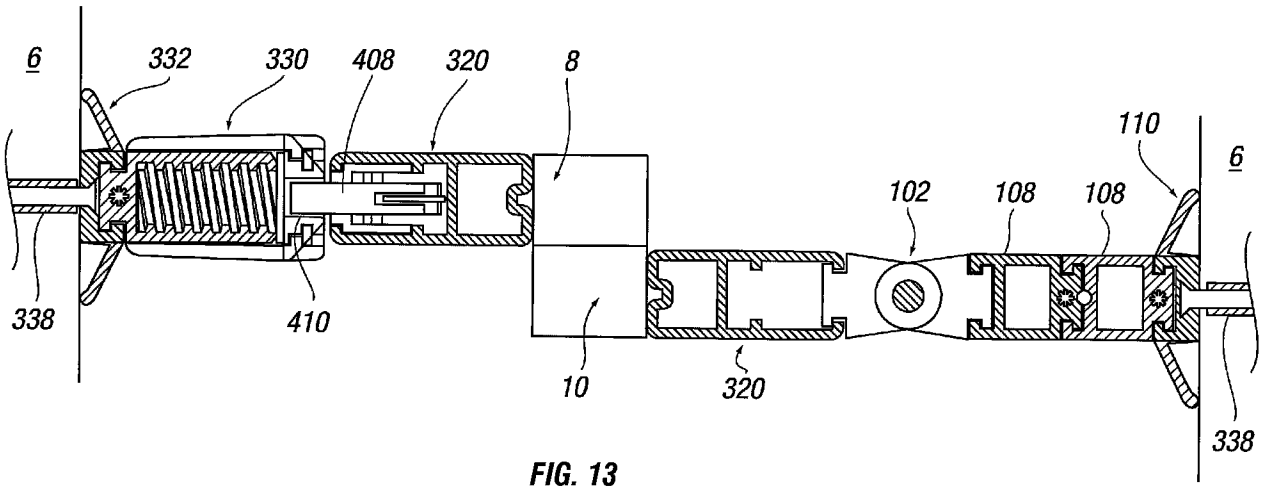
FIG. 13 illustrates an example of different attachment mechanisms in use on the gate assembly.

FIGS. 11 and 13 illustrate engagement of frame 330 to a wall via a wall extrusion member 332 in one embodiment. This attachment is on the left side or latching side of the gate assembly in this example. Wall extrusion member 332 has a substantially centrally located body portion 334 with a channel 336 defined longitudinally thereof. Body portion 334 is secured to a wall surface via a screw 338. Channel 336 has overhanging lips 338 adjacent an opening of said channel for receiving a complementary shaped end of an adjuster housing 340 of frame 330. Housing 340 is slidably received in channel 336. Flanges 342 are provided either side of body portion 334 and are angled from lips 338 to the wall surface to provide a neat aesthetic finish. An adjustment screw 344 is rotatably mounted in housing 340 to allow fine adjustment of the position of the frame 330 relative to wall extrusion member 332. Frame 330 is joined to an end 346 of screw 344.

Figures 12A, 12B, 12C:
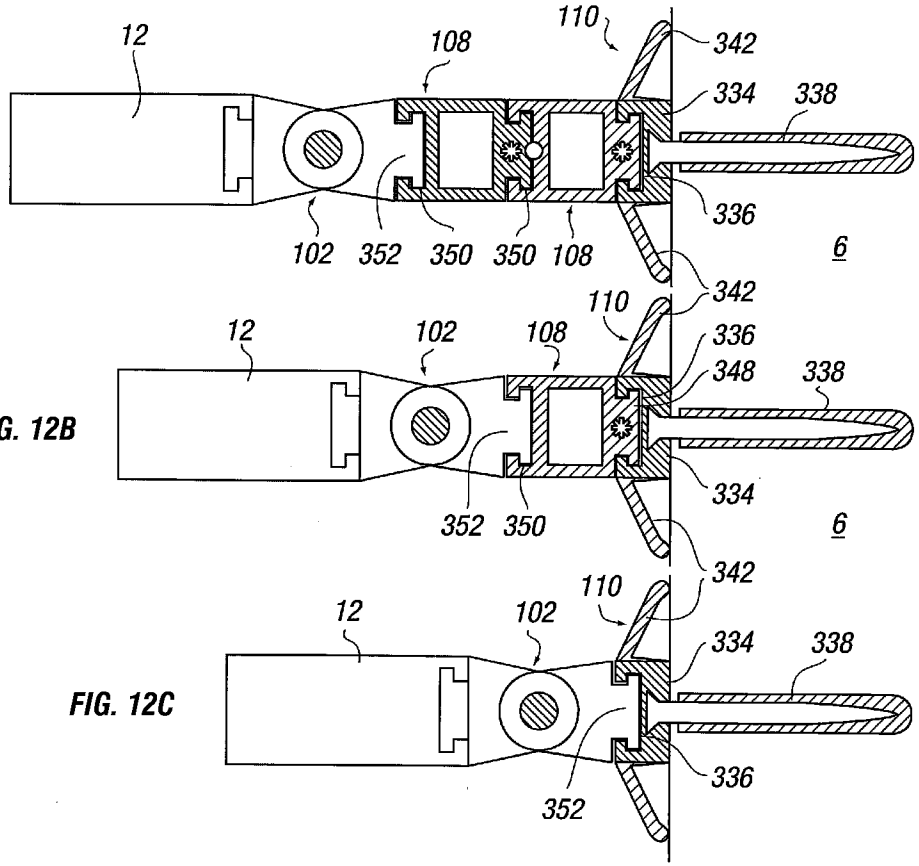
FIGS. 12A-12C illustrate further examples of attachment mechanisms for attaching a frame of the gate assembly to a wall surface defining the opening.

On the right side or hinge side of the gate assembly a similar wall extrusion member 110 to member 332 is provided, as shown in FIGS. 12A-13. However, in this embodiment, a spacing element 108 is slidably inserted in channel 336 in place of adjuster housing 340 in figure 12B. Spacing element 108 has a T shaped end 348 slidably mounted in channel 336 and, at an opposite end, has a channel 350 similar in shape to channel 336. A part of hinge 102 has a T-shaped end 352 for slidable location in channel 350 in FIG. 12B. In figure 12A, an additional spacing element 108 is located in channel 350, thereby further increasing the distance of the hinge from the wall 6. In figure 12C, the hinge 102 is joined directly to channel 336.

Latching Mechanism

A latching mechanism 402 is provided along one side of the gate assembly and an embodiment is illustrated in figures 15A-15D. Mechanism 402 includes a handle portion 404 provided on a lower surface of top panel member 12'. An elongate arm 406 extends downwardly from said handle portion 404 and two latch portions 408 are provided at spaced intervals on the length thereof and protrude outwardly of said arm 406. The elongate arm 406 is joined to an extrusion 410 which is housed in end strut 320. The latch portions 408 are movably located in latch housings 410 provided on frame 330. Thus, as handle 404 is moved in an upwardly direction towards top panel member 12', latch portions 408 are moved upwardly and inwardly of end strut 320, thereby releasing portions 408 from engagement in the latch housings 410 and allowing the gate panel to be moved to an open position.

FIG. 14 shows a more detailed view of latch mechanism 402. Each latch portion 408 is pivotably mounted to a part 420 of arm 406 via a pivot screw 412 and is resiliently biased to a latched position via a spring 414. Latch portion 408 includes a main body 416 with a latching protrusion 418 at an end thereof. Movement of handle 404 in an upwardly direction causes part 420 to move upwardly relative to arm 406, thereby causing an end of latch body 416 of latch portion 408 to engage with an angled surface 422 of arm 406. Further movement of body 416 against surface 422 causes body 416 to pivot, thereby moving latching protrusion 418 inwardly of arm 406.

The components of the gate assembly can be formed from any or any combination of suitable materials, such as wood, metal, fabric and/or the like. The gate panel or panels can be provided in any suitable shape, size and/or design.

The invention claimed is:

1. A gate assembly for positioning in an opening through which selective access is required in use, said gate assembly including two or more gate panels movably mounted to each other via movement means including an elongated slot or channel to allow adjustment of an overall width of the gate assembly to allow fitting of said gate assembly in said opening in use, the movement means comprising:

protruding means provided on at least one of said gate panels which are slidably mounted in the slot or channel provided on the other of said gate panels; and at least two spaced apart location means are associated with said slot or channel that receive said protruding means, thereby providing at least two pre-defined width positions for said gate panels, wherein the location means is in a form of a recess defined in a surface of a wall of the slot or channel, the recess having a rear wall with one or more ramps or angled side walls diverging outwardly therefrom, the outer edges of the ramps or angled side walls defining an opening of the recess, and wherein the protruding means is biased to slidably move in contact with, and over, the walls of the location means as the gate panels slide relative to each other.

2. A gate assembly according to claim 1 wherein locking means are associated with the protruding means and are movable relative to the protruding means between a locked positioned, wherein the protruding means are locked in a required position in said slot or channel to maintain the gate panels at a required width, and an unlocked position, wherein the protruding means are movable in said slot or channel and the position of the gate panels relative to each other can be adjusted.

3. A gate assembly according to claim 2 wherein the locking means is slidably movable in a direction substantially perpendicular to the direction of movement of the protruding means.

4. A gate assembly according to claim 3 wherein the locking means includes a housing and a locking arm slidably mounted in the housing, the locking arm movable in a direction substantially perpendicular to the direction of movement of the protruding means.

5. A gate assembly according to claim 2 wherein the locking means is provided at an end of at least one of the gate panels.

6. A gate assembly according to claim 5 wherein at least part of the locking means protrudes outwardly from the end of the gate panel in an unlocked position and is movable inwardly of the gate panel to move the locking means to a locked position.

7. A gate assembly according to claim 1 wherein resilient biasing means are provided or associated with the protruding means to bias the protruding means into engagement with one of the location means in use.

8. A gate assembly according to claim 1 wherein the protruding means is capable of undergoing reciprocal motion in a direction substantially perpendicular to a longitudinal axis of the slot or channel when moving between engaged and disengaged positions with the location means.

9. A gate assembly according to claim 1 wherein the two or more location means are provided a spaced distance apart along a longitudinal axis of the channel or slot.

10. A gate assembly according to claim 1 wherein a free end of the protruding means has one or more curved or angled side walls which are substantially complementary in form to the angled side walls of the recess.

11. A gate assembly according to claim 1 wherein at least part of each gate panel is provided in overlapping relationship with the other gate panel, each gate panel having protruding means and a slot or channel and the protruding means on each gate panel being movably mounted in the slot or channel on the other gate panel.

12. A gate assembly according to claim 1 wherein each gate panel includes a top panel member, a base panel member and a plurality of spaced apart upright struts arranged between the base and top panel members, the slot or channel being defined in at least the top panel member of the gate panel.

13. A gate assembly according to claim 1, wherein the gate panels are selectively adjustable between a closed position that cover substantially an entire width of the opening to prevent access through the opening, and an open position that covers only a portion of the entire width opening and permits access through an uncovered portion of the opening.

14. A gate assembly according to claim 1, wherein the slot or channel includes an opening, and a surface opposite from the opening, and further wherein the location means comprise recesses in the opposite surface.

15. A gate assembly for positioning in an opening through which selective access is required in use, the gate assembly including two or more gate panels movably mounted to each other via an channel to allow adjustment of an overall width of the gate assembly to allow fitting of the gate assembly in the opening in use, the channel comprising:

a protruding member provided on at least one of the gate panels which is slidably mounted in the channel provided on the other of the gate panels; and at least one recess is associated with the channel to receive the protruding member, wherein the recess is defined in a surface of a wall of the channel, the recess has a rear wall with at least one ramped side wall diverging outwardly therefrom, the outer edge of the ramp defining an opening of the recess, and wherein the protruding member is biased to slidably move in contact with, and over, the walls of the recesses as the gate panels slide relative to each other.

16. A gate assembly according to claim 15, wherein a locking arm is associated with the protruding member and is movable relative to the protruding member between a locked and an unlocked position, where:

in the locked position, the protruding member is disposed in the channel, and in the unlocked position, the protruding member is movable in and out of the recess as the gate panels are in sliding engagement with one another.

* * * * *